US007293738B2

(12) United States Patent
Grébonval et al.

(10) Patent No.: US 7,293,738 B2
(45) Date of Patent: Nov. 13, 2007

(54) FREESTANDING DISPENSER FOR DISPENSING TWO DIFFERENT SUBSTRATES

(75) Inventors: Loïc Grébonval, Flocques (FR); Kenneth Graham Russell, Gravesend (GB); Danny Fraser Masting, Hove (GB); Tammy Jo Balzar, Oshkosh, WI (US); William John Maskell, London (GB); Jason Morenikeji, London (GB); Gerard Michael O'Brien, Rickmansworth Herts (GB); David Eugene Salmon, Watford Herts (GB)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 147 days.

(21) Appl. No.: 10/722,805

(22) Filed: Nov. 26, 2003

(65) Prior Publication Data

US 2005/0139719 A1 Jun. 30, 2005

(51) Int. Cl.
*B65H 16/04* (2006.01)

(52) U.S. Cl. ..... 242/597.7; 242/597.8

(58) Field of Classification Search ..... 242/594, 242/597.7, 597.8; D6/521, 522, 523; 220/834; 221/33, 34, 45, 46, 61, 63, 92, 199
See application file for complete search history.

(56) References Cited

U.S. PATENT DOCUMENTS

| | | | |
|---|---|---|---|
| 1,045,311 | A | 11/1912 | Moberg |
| 1,532,297 | A | 4/1925 | Bausch et al. |
| 1,588,577 | A | 6/1926 | Heifler |
| 1,664,392 | A | 4/1928 | Baruch |
| 2,382,249 | A | 8/1945 | Megar |
| 2,440,974 | A | 5/1948 | Resch |
| 2,555,205 | A | 5/1951 | Steffens |
| 3,170,652 | A | 2/1965 | Kennedy |
| 3,310,353 | A | 3/1967 | Cordis |
| 3,362,653 | A | 1/1968 | Carlisle |
| 3,368,522 | A | 2/1968 | Cordis |
| 3,523,653 | A | 8/1970 | Hansen |
| 3,532,210 | A | 10/1970 | Minion et al. |
| 3,568,635 | A | 3/1971 | Poitras et al. |
| 3,592,161 | A | 7/1971 | Hoffmann |
| 3,713,170 | A | 1/1973 | Kaufman |
| 3,729,145 | A | 4/1973 | Koo et al. |

(Continued)

FOREIGN PATENT DOCUMENTS

| | | | |
|---|---|---|---|
| DE | 39 38 352 | A | 7/1990 |

(Continued)

OTHER PUBLICATIONS

Derwent World Patent Database abstract of DE 3133237 A: Description of M. Scheepe, "Refill Pack of Moisture-Impregnated Tissues—Are Supplied in Aluminum Foil Packets Lined With Plastics."

*Primary Examiner*—John Q. Nguyen
(74) *Attorney, Agent, or Firm*—Scott A. Baum

(57) ABSTRACT

A freestanding dispenser for dual dispensing of a wet substrate and a dry substrate includes: a base for supporting the freestanding dispenser on a substantially horizontal surface; a support member connected to the base, the support member holding a roll of a dry substrate in a substantially vertical position; and a source of a wet substrate supported by the freestanding dispenser.

45 Claims, 6 Drawing Sheets

U.S. PATENT DOCUMENTS

| | | | | |
|---|---|---|---|---|
| 3,756,483 | A | | 9/1973 | Schraeder |
| 3,770,118 | A | | 11/1973 | Jones |
| 3,775,801 | A | | 12/1973 | Walker |
| 3,780,908 | A | | 12/1973 | Fitzpatrick et al. |
| 3,784,055 | A | | 1/1974 | Anderson |
| 3,794,253 | A | | 2/1974 | Megdall |
| 3,795,355 | A | | 3/1974 | Gerstein |
| 3,836,044 | A | | 9/1974 | Tilp et al. |
| 3,836,045 | A | | 9/1974 | Duhy et al. |
| 3,837,595 | A | | 9/1974 | Boone |
| 3,841,466 | A | | 10/1974 | Hoffman et al. |
| 3,843,017 | A | | 10/1974 | Harrison |
| 3,847,722 | A | | 11/1974 | Kistner |
| 3,848,822 | A | | 11/1974 | Boone |
| 3,890,622 | A | | 6/1975 | Alden |
| 3,913,522 | A | | 10/1975 | Light |
| 3,949,947 | A | | 4/1976 | Youngquist et al. |
| 3,967,756 | A | | 7/1976 | Barish |
| 3,970,215 | A | | 7/1976 | McLaren et al. |
| 3,973,695 | A | | 8/1976 | Ames |
| 3,982,659 | A | | 9/1976 | Ross |
| 3,986,479 | A | | 10/1976 | Bonk |
| 3,994,417 | A | | 11/1976 | Boedecker |
| 3,995,582 | A | | 12/1976 | Douglas |
| 4,002,264 | A | | 1/1977 | Marchesani |
| 4,004,687 | A | | 1/1977 | Boone |
| 4,030,676 | A | * | 6/1977 | Bardsley ..... 242/597.7 |
| 4,058,354 | A | | 11/1977 | Powaska |
| 4,069,789 | A | | 1/1978 | Fukagawa et al. |
| 4,101,026 | A | | 7/1978 | Bonk |
| 4,106,433 | A | | 8/1978 | Fernando et al. |
| 4,106,616 | A | | 8/1978 | Boone |
| 4,106,617 | A | | 8/1978 | Boone |
| 4,135,199 | A | | 1/1979 | Kurland et al. |
| 4,138,034 | A | | 2/1979 | Mccarthy |
| 4,147,441 | A | | 4/1979 | Harrison et al. |
| 4,171,047 | A | | 10/1979 | Doyle et al. |
| 4,180,160 | A | | 12/1979 | Ogawa et al. |
| 4,191,317 | A | | 3/1980 | Harkins |
| 4,205,802 | A | | 6/1980 | Economakis |
| 4,219,129 | A | | 8/1980 | Sedgwick |
| 4,235,333 | A | | 11/1980 | Boone |
| 4,260,117 | A | | 4/1981 | Perrin et al. |
| 4,274,573 | A | | 6/1981 | Finkelstein |
| 4,328,907 | A | | 5/1982 | Beard |
| 4,369,929 | A | | 1/1983 | Cayer |
| 4,401,248 | A | | 8/1983 | Helms |
| 4,411,374 | A | | 10/1983 | Hotchkiss |
| 4,436,221 | A | | 3/1984 | Margulies |
| 4,436,224 | A | | 3/1984 | McInerny |
| 4,453,634 | A | | 6/1984 | Blumenthal |
| 4,467,974 | A | | 8/1984 | Crim |
| 4,478,354 | A | | 10/1984 | Notheis |
| 4,487,376 | A | * | 12/1984 | Compton ..... 242/423.1 |
| 4,516,676 | A | | 5/1985 | Cournoyer |
| 4,519,308 | A | | 5/1985 | Eberle |
| 4,526,291 | A | | 7/1985 | Margulies |
| 4,534,491 | A | | 8/1985 | Norton et al. |
| 4,535,912 | A | * | 8/1985 | Bonk ..... 221/46 |
| 4,566,606 | A | | 1/1986 | Kling |
| 4,570,820 | A | | 2/1986 | Murphy |
| 4,651,895 | A | | 3/1987 | Niske et al. |
| 4,676,131 | A | | 6/1987 | Cassia |
| 4,690,345 | A | | 9/1987 | Cotey |
| 4,735,317 | A | | 4/1988 | Sussman et al. |
| 4,738,176 | A | | 4/1988 | Cassia |
| D297,895 | S | | 10/1988 | Mattei |
| D298,597 | S | * | 11/1988 | Bell ..... D6/521 |
| 4,784,290 | A | | 11/1988 | Howard |
| 4,830,301 | A | | 5/1989 | Miller |
| 4,834,316 | A | | 5/1989 | Delorean |
| 4,860,893 | A | | 8/1989 | Kaufman |
| D303,890 | S | | 10/1989 | Pilot |
| 4,877,133 | A | | 10/1989 | Klenter et al. |
| 4,883,197 | A | | 11/1989 | Sanchez et al. |
| 4,884,690 | A | | 12/1989 | Klenter et al. |
| D306,809 | S | | 3/1990 | Joseph |
| 4,936,452 | A | | 6/1990 | Pauley |
| D311,106 | S | | 10/1990 | Jaber |
| 4,964,526 | A | | 10/1990 | Stephens |
| 4,978,095 | A | | 12/1990 | Phillips |
| 4,984,530 | A | | 1/1991 | Dutton |
| 4,991,538 | A | | 2/1991 | Davids et al. |
| 5,050,737 | A | | 9/1991 | Joslyn et al. |
| 5,097,998 | A | | 3/1992 | Shimasaki |
| 5,104,054 | A | | 4/1992 | Latham |
| 5,134,957 | A | | 8/1992 | Nobili |
| 5,145,091 | A | | 9/1992 | Meyers |
| D329,978 | S | | 10/1992 | Ryan |
| 5,170,958 | A | | 12/1992 | Brown |
| 5,192,044 | A | | 3/1993 | Baskin |
| 5,193,759 | A | | 3/1993 | Bigelow et al. |
| 5,195,689 | A | | 3/1993 | Beer et al. |
| 5,207,367 | A | | 5/1993 | Dunn et al. |
| 5,215,757 | A | | 6/1993 | El-Nokaly |
| 5,219,092 | A | | 6/1993 | Morand |
| 5,228,632 | A | | 7/1993 | Addison et al. |
| 5,242,057 | A | | 9/1993 | Cook et al. |
| 5,255,861 | A | | 10/1993 | Lerner |
| D342,635 | S | | 12/1993 | Carter et al. |
| 5,305,937 | A | | 4/1994 | Barnett |
| 5,310,262 | A | | 5/1994 | Robison et al. |
| 5,311,986 | A | | 5/1994 | Putz |
| D347,534 | S | | 6/1994 | Gottselig |
| 5,335,811 | A | | 8/1994 | Morand |
| 5,346,064 | A | | 9/1994 | Rizzuto |
| 5,368,157 | A | | 11/1994 | Gasparrini et al. |
| 5,392,945 | A | | 2/1995 | Syrek |
| 5,409,181 | A | | 4/1995 | Patrick |
| 5,439,521 | A | | 8/1995 | Rao |
| 5,452,832 | A | | 9/1995 | Niada |
| 5,467,893 | A | | 11/1995 | Landis et al. |
| 5,473,789 | A | | 12/1995 | Oster |
| 5,509,593 | A | | 4/1996 | Bloch et al. |
| 5,533,621 | A | | 7/1996 | Schoal |
| 5,542,566 | A | | 8/1996 | Glaug et al. |
| 5,542,568 | A | | 8/1996 | Julius |
| D377,284 | S | | 1/1997 | Farrow et al. |
| 5,598,987 | A | | 2/1997 | Wachowicz |
| 5,599,555 | A | | 2/1997 | El-Nokaly |
| 5,604,992 | A | | 2/1997 | Robinson |
| 5,609,269 | A | | 3/1997 | Behnke et al. |
| 5,618,008 | A | | 4/1997 | Dearwester et al. |
| 5,630,526 | A | | 5/1997 | Moody |
| 5,630,563 | A | | 5/1997 | Meisner et al. |
| 5,638,957 | A | | 6/1997 | Brasier |
| 5,642,810 | A | | 7/1997 | Warner et al. |
| 5,649,676 | A | | 7/1997 | Lord |
| 5,651,487 | A | | 7/1997 | Hansen |
| D381,851 | S | | 8/1997 | Sharpe |
| 5,655,661 | A | | 8/1997 | Rigby |
| 5,660,313 | A | | 8/1997 | Newbold |
| 5,660,636 | A | | 8/1997 | Shangold et al. |
| 5,667,092 | A | | 9/1997 | Julius et al. |
| 5,672,206 | A | | 9/1997 | Gorman |
| D386,025 | S | | 11/1997 | Mervar et al. |
| 5,687,875 | A | | 11/1997 | Watts et al. |
| 5,697,577 | A | | 12/1997 | Ogden |
| 5,704,566 | A | | 1/1998 | Schutz et al. |
| 5,716,920 | A | | 2/1998 | Glenn et al. |
| D394,177 | S | | 5/1998 | Christopher |
| 5,763,984 | A | | 6/1998 | Day |
| 5,765,717 | A | | 6/1998 | Gottselig |
| 5,785,179 | A | | 7/1998 | Buczwinski et al. |

| | | | | |
|---|---|---|---|---|
| D397,265 | S | 8/1998 | Badillo | |
| 5,803,249 | A | 9/1998 | Harsanyi et al. | |
| RE35,976 | E | 12/1998 | Gasparrini et al. | |
| 5,848,762 | A | 12/1998 | Reinheimer et al. | |
| 5,863,663 | A | 1/1999 | Mackey et al. | |
| 5,868,275 | A | 2/1999 | Moody | |
| 5,887,759 | A | 3/1999 | Ayigbe | |
| 5,897,074 | A | 4/1999 | Marino | |
| 5,897,539 | A | 4/1999 | Elliesen et al. | |
| 5,904,316 | A | 5/1999 | Dunning et al. | |
| D412,439 | S | 8/1999 | Cormack | |
| 5,938,013 | A | 8/1999 | Palumbo et al. | |
| 5,938,141 | A | 8/1999 | Kanbar | |
| 5,950,960 | A | 9/1999 | Marino | |
| 5,951,762 | A | 9/1999 | Shangold et al. | |
| 5,952,043 | A | 9/1999 | Mackey et al. | |
| D416,794 | S | 11/1999 | Cormack | |
| D417,109 | S | 11/1999 | Johnson et al. | |
| 5,980,931 | A | 11/1999 | Fowler et al. | |
| D417,987 | S | 12/1999 | Velazquez | |
| 6,001,381 | A | 12/1999 | Gordon et al. | |
| 6,003,723 | A | 12/1999 | Morand | |
| D421,691 | S | 3/2000 | Hoblitz | |
| 6,047,920 | A | 4/2000 | Dearwester et al. | |
| 6,056,235 | A | 5/2000 | Brozinsky | |
| 6,059,882 | A | 5/2000 | Steinhardt et al. | |
| 6,079,305 | A | 6/2000 | Bloch et al. | |
| 6,085,899 | A | 7/2000 | Thorsbakken | |
| D429,282 | S | 8/2000 | Velazquez et al. | |
| 6,098,836 | A | 8/2000 | Gottselig | |
| 6,121,165 | A | 9/2000 | Mackey et al. | |
| 6,138,867 | A | 10/2000 | Stelmack | |
| 6,158,614 | A | 12/2000 | Haines et al. | |
| 6,164,442 | A | 12/2000 | Stravitz | |
| 6,179,162 | B1 | 1/2001 | Motsenbocker | |
| 6,182,290 | B1 | 2/2001 | Morris | |
| 6,189,730 | B1 | 2/2001 | Mcclymonds | |
| 6,206,221 | B1 * | 3/2001 | Bando et al. | 220/254.5 |
| 6,213,424 | B1 | 4/2001 | Helfer-Grand | |
| 6,270,878 | B1 | 8/2001 | Wegele et al. | |
| 6,279,775 | B1 | 8/2001 | Parkes et al. | |
| 6,314,971 | B1 | 11/2001 | Schneider | |
| 6,318,590 | B1 | 11/2001 | McMurray-Stivers | |
| 6,321,937 | B1 | 11/2001 | Desimone et al. | |
| 6,346,153 | B1 | 2/2002 | Lake et al. | |
| 6,364,101 | B1 | 4/2002 | Schultz | |
| D457,765 | S | 5/2002 | Peotter et al. | |
| 6,382,552 | B1 | 5/2002 | Paul et al. | |
| 6,394,324 | B1 | 5/2002 | Chen | |
| 6,405,972 | B1 * | 6/2002 | Wakam | 242/597.7 |
| 6,412,656 | B1 * | 7/2002 | Placik | 221/33 |
| 6,427,839 | B1 | 8/2002 | Helfer-Grand | |
| 6,431,405 | B2 | 8/2002 | Irwin | |
| 6,439,386 | B1 | 8/2002 | Sauer et al. | |
| 6,446,808 | B1 | 9/2002 | Paul et al. | |
| 6,503,326 | B1 | 1/2003 | Mikelionis | |
| 6,644,563 | B2 | 11/2003 | Presson | |
| 6,899,250 | B2 * | 5/2005 | FitzSimons et al. | 221/45 |
| 2002/0036208 | A1 | 3/2002 | Faulks et al. | |
| 2002/0162848 | A1 | 11/2002 | Na | |
| 2004/0120988 | A1 * | 6/2004 | Masting | 424/443 |
| 2004/0251265 | A1 | 12/2004 | FitzSimons et al. | |

FOREIGN PATENT DOCUMENTS

| | | | |
|---|---|---|---|
| DE | 297 11 723 | U1 | 10/1997 |
| DE | 297 19 026 | U1 | 3/1998 |
| DE | 197 16 254 | A1 | 1/1999 |
| DE | 298 12 501 | U1 | 3/1999 |
| DE | 299 01 086 | U1 | 7/1999 |
| DE | 199 37 881 | A1 | 2/2001 |
| EP | 0 122 809 | A1 | 10/1984 |
| EP | 0 251 103 | B1 | 2/1990 |
| EP | 0 193 130 | B1 | 5/1990 |
| EP | 0 235 438 | B1 | 1/1991 |
| EP | 0 119 314 | B1 | 6/1991 |
| EP | 0 501 905 | A1 | 9/1992 |
| EP | 0 420 301 | B1 | 10/1993 |
| EP | 0 368 240 | B1 | 1/1995 |
| EP | 0 858 758 | A1 | 8/1998 |
| EP | 0 750 063 | B1 | 10/1999 |
| EP | 1 048 257 | A2 | 11/2000 |
| EP | 1 059 032 | A1 | 12/2000 |
| EP | 0 789 642 | B1 | 1/2001 |
| EP | 0 836 842 | B1 | 4/2001 |
| EP | 0 865 247 1 | B | 3/2002 |
| GB | 2 252 954 | A | 8/1992 |
| GB | 2 270 901 | | 3/1994 |
| GB | 2 394 219 | A | 4/2004 |
| WO | WO 91/19663 | A1 | 12/1991 |
| WO | WO 96/21388 | A1 | 7/1996 |
| WO | WO 98/08763 | A1 | 3/1998 |
| WO | WO 99/06311 | A2 | 2/1999 |
| WO | WO 99/29602 | A1 | 6/1999 |
| WO | WO 99/53816 | A1 | 10/1999 |
| WO | WO 01/42117 | A1 | 6/2001 |
| WO | WO 01/64525 | A2 | 9/2001 |
| WO | WO 01/76437 | A1 | 10/2001 |
| WO | WO 01/76438 | A1 | 10/2001 |
| WO | WO 01/76439 | A1 | 10/2001 |
| WO | WO 01/76440 | A1 | 10/2001 |
| WO | WO 01/76443 | A2 | 10/2001 |
| WO | WO 01/82763 | A1 | 11/2001 |
| WO | WO 01/82764 | A1 | 11/2001 |
| WO | WO 01/82765 | A1 | 11/2001 |
| WO | WO 01/83866 | A2 | 11/2001 |
| WO | WO 01/89937 | A2 | 11/2001 |
| WO | WO 02/21988 | A1 | 3/2002 |
| WO | WO 02/21989 | A2 | 3/2002 |
| WO | WO 02/064435 | A2 | 8/2002 |

* cited by examiner

FREESTANDING DISPENSER FOR DISPENSING TWO DIFFERENT SUBSTRATES

BACKGROUND

Often substrates are packaged as a roll of individual sheets separated by perforations or as a stack of individual sheets housed within a dispenser. Within the dispenser, the stack of individual sheets can be folded or interfolded if desired. While these packaging formats are useful to a consumer who desires utilizing two different substrates, such as a wet substrate and a dry substrate for cleaning or other purposes, the consumer must buy and store two individually packaged products that are placed into two different dispensers. This often results in one or both of the substrates being stored under a cabinet or in a drawer since insufficient space can prevent both products and their dispensers from being placed in a readily accessible position such as a kitchen counter. Because cleaning is a chore, people want it done as quickly as possible and they will reach for whatever is readily available. Therefore, if both substrates and their dispenser are not readily available, the stored substrate is often not utilized.

When using a dispenser, people generally do not like to permanently attach the dispenser to walls, counters, cabinets, or mounting surfaces within their home. In general, permanent mounting of the dispenser requires the use of screws or other fasteners that can damage the mounting surface. If an adhesive is used, removal of the dispenser can leave a residue or damage to the underlying surface. Permanent mounting can also require cutting or otherwise modifying the mounting surface. For example, installing a recessed bath tissue dispenser requires cutting a hole into the wall to mount the dispenser. If the dispenser is no longer required or needs to be moved, the mounting surface is unacceptably altered.

Also, when using a dispenser, people generally have a limited amount of counter space in their kitchen or bathroom. That same counter is also used to store other items that are used on a daily basis. A dispenser that requires a large amount of counter space is unlikely to be placed on the counter.

Thus, a need exists for a convenient way of dispensing two different substrates from a single dispenser. A need also exists for a dispenser that does not require permanent attachment to a mounting surface. A need also exists for a compact dispenser that does not take up a large amount of space.

SUMMARY

Described herein are several embodiments of a freestanding dispenser for dispensing two or more substrates such that the substrates are readily available to be dispensed fulfilling the above needs. The freestanding dispenser can be conveniently placed on a counter or other surface providing ready access to each substrate without the need to permanently mount the freestanding dispenser. A roll of a dry substrate is held substantially vertically by the freestanding dispenser, enabling the freestanding dispenser to be as compact as possible.

In one embodiment, a freestanding dispenser for dual dispensing of a wet substrate and a dry substrate includes: a base for supporting the freestanding dispenser on a substantially horizontal surface; a support member connected to the base, the support member holding a roll of a dry substrate in a substantially vertical position; and a source of a wet substrate supported by the freestanding dispenser.

BRIEF DESCRIPTION OF THE DRAWINGS

The above aspects and other features, aspects, and advantages of the present invention will become better understood with regard to the following description, appended claims, and accompanying drawings in which:

Figure 1:
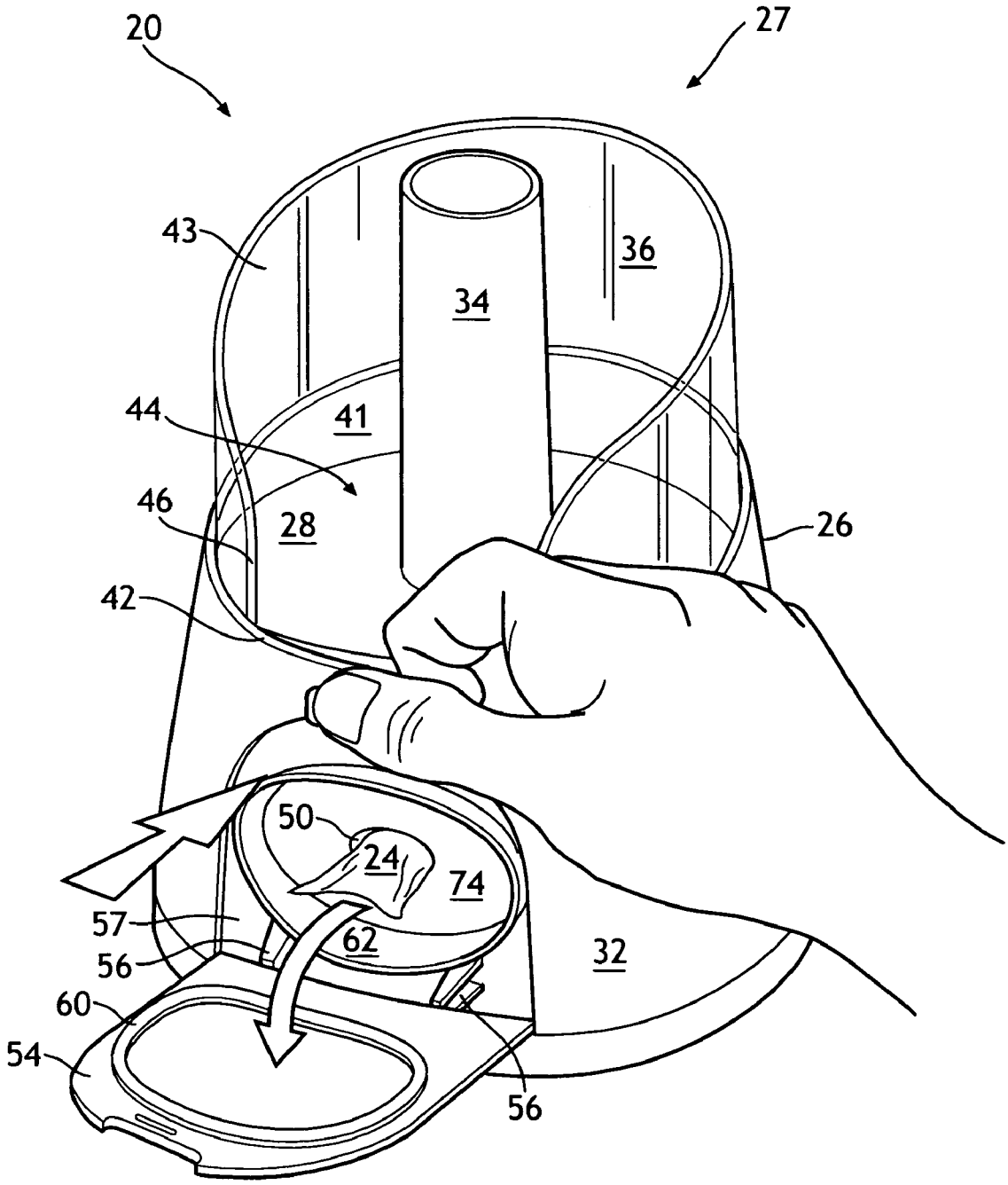
FIG. 1 illustrates a perspective view of one embodiment of the invention.

Repeated use of reference characters in the specification and drawings is intended to represent the same or analogous features or elements of the invention.

DEFINITIONS

As used herein, including the claims, forms of the words "comprise," "have," and "include" are legally equivalent and open-ended. Therefore, additional non-recited elements, functions, steps or limitations may be present in addition to the recited elements, functions, steps, or limitations.

As used herein "substrate" is a flexible sheet or web material, which is useful for household chores, personal care, health care, food wrapping, and cosmetic application or removal. Non-limiting examples of suitable substrates for use with the freestanding dispenser include nonwoven substrates; woven substrates; hydro-entangled substrates; air-entangled substrates; paper substrates comprising cellulose such as tissue paper, toilet paper, or paper towels; waxed paper substrates; coform substrates comprising cellulose fibers and polymer fibers; wet substrates such as wet wipes, moist cleaning wipes, moist toilet paper wipes, and baby wipes; film or plastic substrates such as those used to wrap food; and metal substrates such as aluminum foil. Furthermore, laminated or plied together substrates of two or more layers of any of the preceding substrates are also suitable.

As used herein "wet substrate" includes substrates that are either wet or pre-moistened by an appropriate liquid, partially moistened by an appropriate liquid, or substrates that are initially dry but intended to be moistened prior to use by placing the substrate into an appropriate liquid such as water or a solvent. Non-limiting examples of suitable wet substrates include a substantially dry substrate (less than 10% by weight of water) containing lathering surfactants and conditioning agents either impregnated into or applied to the substrate such that wetting of the substrate with water prior to use yields a personal cleansing product. Such substrates are disclosed in U.S. Pat. No. 5,980,931 entitled Cleansing Products Having A Substantially Dry Substrate issued to Fowler et al. on Nov. 9, 1999. Other suitable wet substrates can have encapsulated ingredients such that the capsules rupture during dispensing or use. Examples of encapsulated materials include those disclosed in U.S. Pat. No. 5,215,757 entitled Encapsulated Materials issued to El-Nokaly on Jun. 1, 1993, and U.S. Pat. No. 5,599,555 entitled Encapsulated Cometic Compositions issued to El-Nokaly on Feb. 4, 1997. Other suitable wet substrates include dry substrates that deliver liquid when subjected to in-use shear and compressive forces. Such substrates are disclosed in U.S. Pat. No. 6,121,165 entitled Wet-Like Cleaning Articles issued to Mackay et al. Sep. 19, 2000.

As used herein "substantially vertical" means that the roll's axis of revolution as held in the freestanding dispenser is closer to a vertical axis than a horizontal axis. Thus, the angle between the roll's axis of revolution when held in the freestanding dispenser and a vertical axis for a substantially vertical roll is less than 45 degrees.

As used herein "substantially horizontal" means that the surface is within ±20° degrees of true horizontal or level.

DETAILED DESCRIPTION

It is to be understood by one of ordinary skill in the art that the present discussion is a description of specific embodiments only and is not intended to limit the broader aspects of the present invention.

Referring now to FIGS. 1, 2, 3, and 4, one embodiment of a freestanding dispenser 20 for dispensing a dry substrate 22 and a wet substrate 24 is illustrated. The freestanding dispenser includes a base 26 for supporting the freestanding dispenser on a substantially horizontal surface; a support member 27 connected to the base, the support member holding a roll 35 of a dry substrate in a substantially vertical position; and a source of a wet substrate 24 supported by the freestanding dispenser.

In one embodiment, at least a portion of the roll's exterior surface is exposed in order to provide ready access to the dry substrate for dispensing, locating the tail, or for rewinding the roll if an excess amount of the dry substrate has unwound from the roll during dispensing. In various embodiments of the invention, the exposed exterior surface can be approximately 100 percent of the roll's exterior surface, approximately 75 percent of the roll's exterior surface, approximately 50 percent of the roll's exterior surface, approximately 25 percent of the roll's exterior surface, or approximately 10 percent of the roll's exterior surface. Furthermore, ranges for the roll's exposed exterior surface can include any of the previous values as either an upper or a lower limit such as the exposed exterior surface is between approximately 50 percent to approximately 100 percent.

In one embodiment, the base 26 can include a top 28, a bottom 30, and a sidewall 32. The base can also include an anti-skid member on the bottom, such as an elastomeric material, or cork material to minimize movement of the base during dispensing and/or to protect the substantially horizontal surface from damage. As illustrated, the wet substrate is housed in the base and the dry substrate is vertically stacked above the wet substrate. In one embodiment, the dry substrate is a dry paper product such as a roll of bathroom tissue or a roll of paper towels and the wet substrate is a wet wipe.

To hold the roll in a substantially vertical position, the freestanding dispenser can include a spindle support member 34, or a shroud support member 36, or both a spindle and a shroud support member as illustrated. The spindle support member holds the roll 35, such as a paper towel roll or bathroom tissue roll, during dispensing as the roll unwinds. The spindle can be detachable from the top by using an appropriate fastening element or the spindle can be molded as an extension of the top or base. If a removable spindle is used, a coreless roll can be dispensed. With the spindle removed, the shroud support member can be used to hold the coreless roll in a substantially vertical position while dispensing the dry substrate.

The fastening element can include any fastening means known to those of skill in the art for attaching one member (the spindle) to another member (the top or the base). Such fastening means include without limitation, a location fit of the spindle in a bore, a press fit of the spindle in a bore, a twist lock using lugs and/or recessed portions to engage the spindle with the base; a tab or a slot, a snap fit, a threaded fastener, adhesives, magnets, and mechanical fasteners such as hook and loop material.

The spindle 34 can be any diameter needed for insertion into the core of the roll while allowing for rotation of the roll about the spindle. The spindle can have any desired cross-section such as round, square, triangular, oval, hexagonal, octagonal, or conical that allows for rotation of the roll about the spindle. The spindle can be solid or hollow and may be beveled on the upper end to improve the insertion of the roll. It is contemplated that if a removable spindle is used, two or more spindles can be supplied—a shorter spindle for use with bathroom tissue rolls and a longer spindle for use with paper towel rolls. In various embodiments of the invention, the spindle can have a diameter between about 5 mm to about 100 mm, or between about 35 mm to about 55 mm.

The length of the spindle can be greater than, less than, or equal to the height of the roll. For some embodiments, it is desirable to have a short spindle, while for other embodiments the spindle may extend completely through the roll. If desired, a fastener may be added to the end of the spindle extending through the roll to securely retain the roll on the spindle. In various embodiments of the invention, the spindle can have a length of about 10 mm or greater, about 50 mm or greater, between about 10 mm to about 400 mm, or between about 80 mm to about 300 mm.

In one embodiment, the spindle 34 is tilted at an angle A (38) relative to a vertical axis 40. In another embodiment, the spindle is not tilted and the angle A is 0 degrees. Tilting the roll slightly helps with dispensing of the dry substrate. By tilting the roll, the roll's tail (free end) tends to stay in place against the periphery of the roll. This helps to eliminate the problem of the tail from bending or dropping down where it can interfere with dispensing of the wet substrate. Tilting the roll also helps to position the dry substrate to face a consumer using the dispenser.

The angle A can be about 1 degree or greater, about 3 degrees or greater, between about 0 degrees to about 20 degrees, or between about 0 degrees to about 10 degrees. In the illustrated embodiment the angle A is about 4 degrees.

In one embodiment, the top 28 is tilted at an angle B (42) relative to the vertical axis 40. In another embodiment, the top is not tilted and the angle B is 90 degrees. In yet another embodiment, the top and the spindle are both tilted as illustrated. Similar to tilting the spindle, the top is tilted for improved dispensing of cored rolls or coreless rolls in combination with the optional shroud. When dispensing a coreless roll, tilting the top helps to keep the roll contained within the shroud. The angle B can be about 89 degrees or less, about 87 degrees or less, between about 70 degrees to about 90 degrees, or between about 80 degrees to about 90° degrees. In the illustrated embodiment the angle B is about 86 degrees.

As previously discussed, an optional shroud support member 36 can be attached to the base 26. One function of the shroud is to assist in holding the roll 35 in place when the optional spindle is not used. Another function of the shroud is to protect the dry substrate from splashing or moisture when used near sinks. The shroud can be detachable from the top or base by using an appropriate fastening element or the shroud can be molded as an extension of the top or the base. The shroud can have any shape or size needed to contain or hold the roll substantially vertical.

In one embodiment, the shroud can almost completely surround the roll, have a height approximately equal to or greater than the roll's height, and have a small dispensing slot through which the dry substrate passes. Such an embodiment allows the roll to rotate within the shroud without being dislodged from the freestanding dispenser during dispensing. It is also very effective in preventing accidental splashing of the dry substrate. In another embodiment, the shroud can be sized to simply hold the roll above the wet substrate. The roll can be removed from the shroud for use, and then replaced within the shroud after use. In this embodiment the shroud can completely encircle the roll. In another embodiment, the shroud can include two or more portions—a molded shroud portion 41 that is molded as part of the base and a removable shroud portion 43 that can be attached to the base by a fastening element.

In one embodiment, the removable shroud is attached to a perimeter 42 of the top by tabs that extend from the shroud and serve as fastening elements. The tabs fit into slots molded into the perimeter of the top. The shroud extends along only a portion of the perimeter at the sides and the back of the freestanding dispenser as illustrated. In the front of the freestanding dispenser, a gap (44) is present in the shroud. The gap allows the dry substrate to be dispensed from within the interior enclosed by the shroud. Additionally, the gap creates leading edges 46 that can be used to assist in dispensing the dry substrate. The leading edges can be used to separate and tear individual sheets of the dry substrate, such as a perforated paper towel roll, by providing a surface to engage the substrate and to initiate a tear at the perforation. In other embodiments, the leading edges can be sharpened, serrated, or have a cutting blade or knife attached to them.

The shroud has a height 48 that can be greater than, less than, or equal to the height of the roll. The height of the shroud can be the same along all portions of the shroud or the height can vary. In one embodiment, the height of the shroud increases from the leading edges towards the back of the freestanding dispenser. The height of the shroud can be equal to the length of the spindle or different.

In one embodiment, the base 26 of the freestanding dispenser has at least one opening into the base's interior for dispensing or refilling the wet substrate 24, which is contained within the interior of the base. The opening can be any size or shape needed for dispensing and/or refilling the wet substrate and can be located anywhere in the base. In one embodiment, the base includes a dispensing opening 50 in the sidewall 32 and a refill opening 52 in the bottom 30. If needed, the base can also be weighted for increased stability of the freestanding dispenser.

The dispensing opening can include any manner of plastic films, dispensing windows, flexible dispensing members, or dispensing flanges that project into the dispensing opening or reside in or adjacent to the dispensing opening for assisting in dispensing the wet substrate. Typically these elements are provided to reduce the size of the dispensing opening while still allowing ready access to the wet substrate through the opening, or to assist in preventing pre-moistened wet substrates from drying out, or to hold the wet substrate in position within the opening for dispensing while preventing the wet substrate from falling back to within the interior of the dispenser.

The freestanding dispenser can also include a dispensing door 54 attached to the base that covers the dispensing opening. The dispensing door can be operably attached to any portion of the base to enable access to the dispensing opening and to cover the dispensing opening reducing moisture loss when housing pre-moistened wet substrates. In one embodiment, a pair of hinges 56 attached to either the sidewall or to an interior housing 57 pivotally connects the dispensing door to the base such that the door opens by rotating down. The hinges are located near the bottom of the base. The dispensing door can be biased to spring open by a biasing element such as a spring, a torsion bar, a sealing gasket, or a flexible strip. To open the dispensing door, a button 58 can be pushed to unlock the dispensing door allowing it to spring open.

To further assist in keeping pre-moistened wet substrates from drying out, the freestanding dispenser can also include a flange 60 surrounding the dispensing opening. The flange can be molded or attached to the sidewall, the dispensing door, or the interior housing. The flange can assist in preventing moisture loss when the dispensing door is closed. The freestanding dispenser can also include a sealing ring 62 surrounding the dispensing opening. The sealing ring can be molded or attached to the sidewall, the dispensing door, or the interior housing. The freestanding dispenser may use the flange, the sealing ring or both. The sealing ring in cooperation with the flange provides for a compressive airtight seal of the dispensing opening when the dispensing door is closed.

The sealing ring can be made from a flexible or compressive material such that when the button is pushed, the compression of the sealing ring will cause the door to spring open. The sealing ring can also include an upper and a lower extension projecting from the sealing ring. The upper extension can be used as a spring or biasing element for the button when placed beneath the button. The lower extension can be used as a dispensing door stop to prevent the dispensing door from freefalling and hitting the horizontal surface (counter). As such, the door will be held open slightly above the counter after the button is pushed. Since the sealing ring can be flexible any associated noise from the dispensing door hitting the door stop can be minimized.

In one embodiment, the base of the freestanding dispenser includes a dispensing compartment 64 and a storage compartment 66. The dispensing compartment can be used to house the wet substrate such that it is accessible through the dispensing opening. The storage compartment can be used to store additional wet substrates prior to placement into the dispensing compartment. In one embodiment, the dispensing compartment is provided by the interior housing 57 that is placed within the base's interior. The interior housing can also include the dispensing opening, hinges for the dispensing door, hinges for the button, and extensions for holding the interior housing in place. These items can be molded as part of the same component. In another embodiment, the base's interior volume is simply partitioned by a wall to provide the dispensing compartment and the storage compartment.

To close either the dispensing compartment, refill compartment, or both, the freestanding dispenser can include a refill cover 68. The refill cover can be pivotally attached to the bottom of the freestanding dispenser and held in a closed position by a spring tab 70 that engages with the bottom when the refill cover is closed.

To further assist in keeping pre-moistened wet substrates from drying out, the freestanding dispenser can also include a gasket 72 that seals the dispensing compartment when the refill cover is closed. The gasket can be molded or attached to the refill cover, the interior housing, or both, or surround the refill opening and seal with the refill cover.

In one embodiment, the wet substrate is housed in a package such as a flexible soft pack 74 having a peel label 76. The wet substrate comprises an interfolded stack of wet wipes. Such packaging is commonly used to economically package wet wipes.

Use of the freestanding dispenser is quite straight forward. As illustrated, the peel label is removed from the soft pack, and then the soft pack is inserted into the dispensing compartment such that the wet substrate is accessible through the dispensing opening. If desired, an additional soft pack can be placed into the refill compartment and the refill cover is closed. The dry substrate roll is placed over the spindle or into the shroud and the freestanding dispenser is placed onto the substantially horizontal surface for use. Typical placements might include work benches, kitchen or bathroom counters, tables, cabinets, and the like.

For cleaning with the dry substrate, the roll is unwound and the substrate is torn or cut to the desired length for use. For cleaning with the wet substrate, the button is pushed to enable the dispensing door to spring open, and the wet substrate removed. If needed, the wet substrate is moistened to activate the surfactants or other chemicals applied to the wet substrate prior to use. Thus, the freestanding dispenser enables ready access to both substrates and provides convenient dispensing of both substrates from one integrated freestanding dispenser. Furthermore, the freestanding dispenser is compact enabling placement on counters or other substantially horizontal surfaces without taking up too much space.

Figure 6:
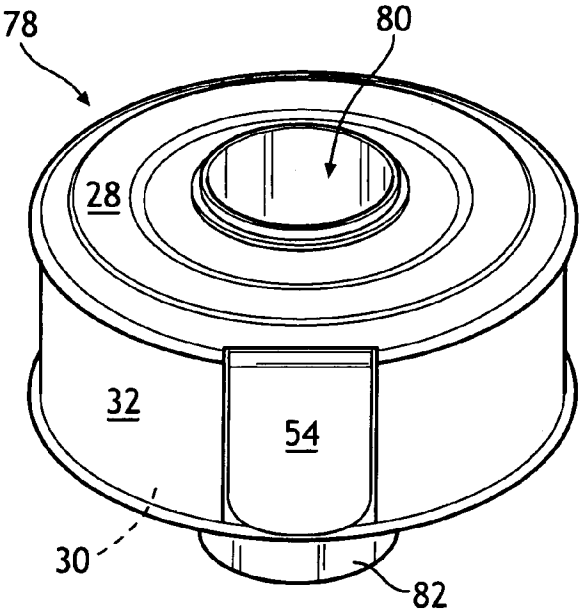
FIG. 6 illustrates the container of the embodiment of FIG. 5.
Figure 5:
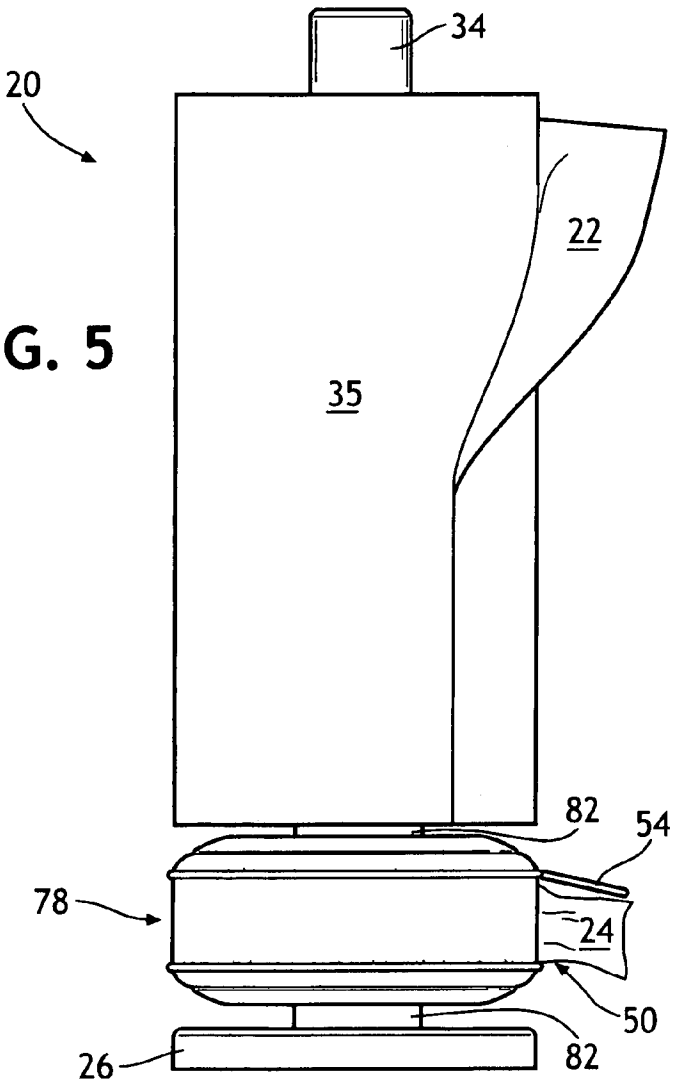
FIG. 5 illustrates another embodiment of the invention.

Referring now to FIGS. 5 and 6 another embodiment of the invention is illustrated. In this embodiment of the freestanding dispenser, the roll 35 is supported by a spindle support member 34 attached to the base 26. The spindle can be either permanently affixed to the base or detachable from the base by use of a fastening element. The wet substrate 24 is housed in a separate removable container 78. The container can be vertically stacked either above or below the roll 35 by placing the container onto the spindle. If desired, multiple containers can be stacked on the spindle such as one above the roll and another beneath the roll. The container can also be used with a dispenser having a horizontal spindle.

In one embodiment, the container includes a top 28, a bottom 30, a sidewall 32, a dispensing opening 50 in the sidewall, and a bore 80 though the top and the bottom. The bore enables the container to be attached to the freestanding dispenser by sliding the container onto the spindle.

In one embodiment, the container's bottom and sidewall can be molded as one piece and the top can be detachable from the sidewall. The sidewall can be generally circular and the container can have a diameter equal to the roll diameter. In other embodiments, the container's diameter can be less than or greater than the roll's diameter.

The height of the dispenser can vary with the wet substrate housed within it. The height is also influenced to some degree by the height of the roll, the space available for the combination, the wet substrate to be dispensed, and the aesthetics of the combination. In one embodiment, the container's height was approximately 50 mm.

In one embodiment, the container can include a sleeve 82 inserted into the bore 80. The sleeve can be a separate part that is inserted through the container or the sleeve can be molded as part of the container. For example the sleeve can be molded as part of the container's bottom extending through the middle of the container and out through the top. The sleeve provides a larger and/or longer bearing surface for supporting the container on the spindle. Alternatively, the sleeve can be used to hold or insert the container into the core of the roll. In this mode, the sleeve can be sized for a light press fit to hold the container in the core of the roll.

Additionally, the sleeve can extend past the top, past the bottom, or past both the top and the bottom. This provides the advantage of spacing the container vertically by leaving a gap between the container's top or bottom and the base, the roll, or both. By spacing the container vertically, especially from the roll, frictional drag is reduced when dispensing the roll by eliminating or reducing contact between the roll and the container. The sleeve can extend past the top, past the bottom, or past both for a distance between about 1 to about 50 mm. Alternatively, the top can be chamfered, concave, or dished to reduce the area in contact with the roll.

In one embodiment, the sleeve can extend past the container's top a substantial distance and function as the spindle for the dry roll. The bottom of the container can serve as the base. The wet substrate can be threaded through the hollow sleeve, which can be molded as an extension of the top, and be dispensed out of the sleeve. A dispensing door 54 can be included to cover the sleeve's end and help retain moisture in the wet substrate. In this embodiment, the wet substrate will be contained in the base of the dispenser similar to the embodiment of FIG. 1, except that the wet substrate is threaded and dispensed through the hollow spindle.

In one embodiment, the container can include a dispensing door 54. The dispensing door can be attached to the container as needed for covering the dispensing opening. For example, the dispensing cover can be attached to the removable top by hinges. As mentioned previously, the dispensing opening can include any manner of plastic films, dispensing windows, flexible dispensing members, or dispensing flanges that project into the dispensing opening or reside in or adjacent to the dispensing opening for assisting in dispensing the wet substrate.

In one embodiment, the wet substrate can be wound into a wet roll having a central hole though the axis of the roll. The wet roll can include a core in the hole if desired. The wet substrate can be perforated into individual sheets. The wet roll is then placed into the interior of the container, by removing the top from the molded bottom and sidewall piece. The top is then replaced and the container positioned onto the spindle either above or below the roll 35 by inserting the spindle through the top and the bottom. In other embodiments, the wet substrate can be folded or pop-up.

When the container is placed on top of the roll, it can be used as a brake to control the roll's rotation during dispensing. In this embodiment, the extension of the sleeve past the bottom of the container is sized to allow at least a portion of the container's bottom to touch the roll when a vertical force is applied to the container. Thus, a perforated roll can be easily dispensed by pulling on the substrate's free end, then pushing on the container to stop the roll from continuing to rotate, which creates enough drag to tear the substrate at the perforations.

Thus, the freestanding dispenser enables ready access to both substrates and provides convenient dispensing of both substrates from one integrated freestanding dispenser. Furthermore, the freestanding dispenser is compact enabling placement on counters or other substantially horizontal surfaces without taking up too much space.

Figure 8:
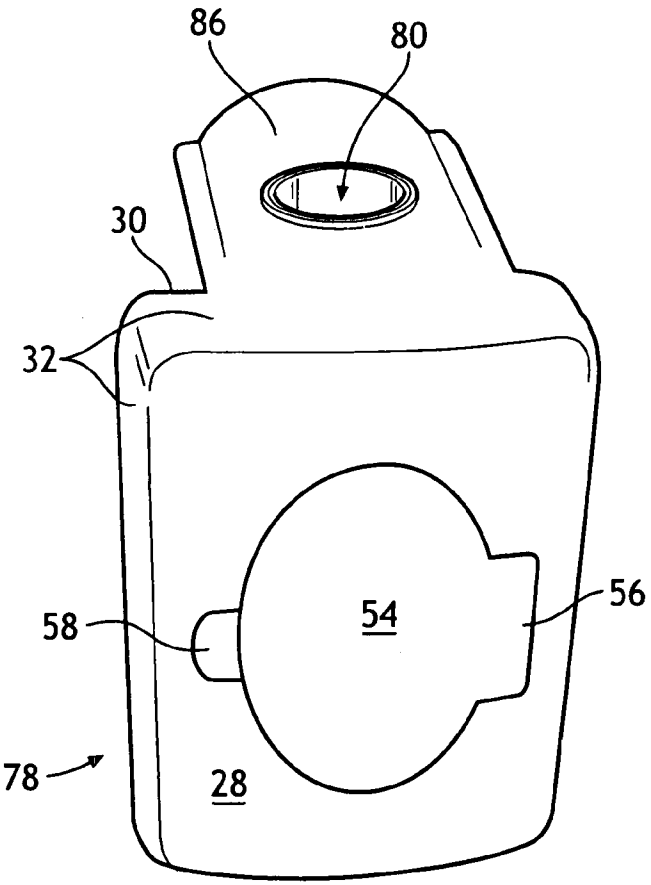
FIG. 8 illustrates the container of the embodiment of FIG. 7.
Figure 7:
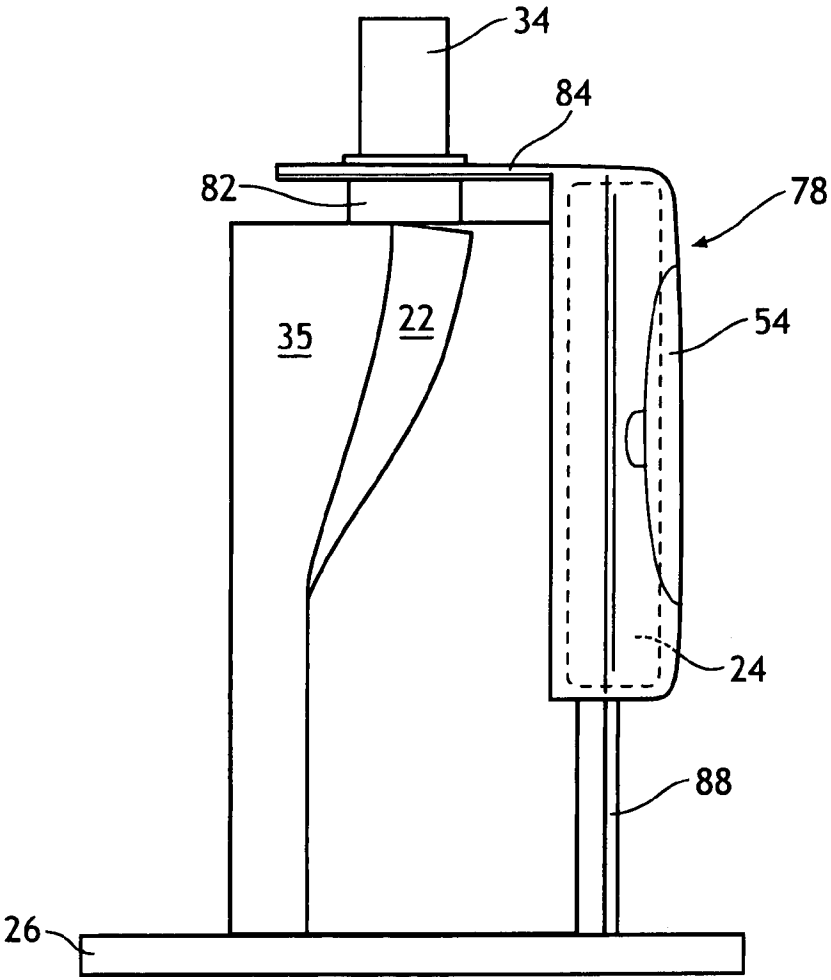
FIG. 7 illustrates another embodiment of the invention.

Referring now to FIGS. 7 and 8 another embodiment of the invention is illustrated. In this embodiment of the freestanding dispenser, the roll 35 is supported by a spindle support member 34 attached to the base 26. The spindle can be either permanently affixed to the base or detachable from the base by use of a fastening element. The wet substrate 24 is housed in a separate removable container 78 attached to the spindle by a hanger member 84. The container places the wet substrate adjacent to the top of roll 35 when the hanger member is placed onto the spindle after the roll as illustrated. Alternatively, the container can be inverted and the hanger member placed onto the spindle first and the roll positioned over the hanger member. This would position the container adjacent to the bottom of the roll near the base and slightly elevate the roll from the base.

The hanger member 84 can be a hook, a clip, a strap, or other method of attaching the container to the spindle. In one embodiment, the hanger member can include an extension member 86 having a hole or a bore 80 though the extension member. The extension member can be attached to the container as needed to support the container when the spindle is inserted through the bore. In one embodiment, the extension member was molded as an extension of the sidewall as illustrated in FIG. 8.

In one embodiment, the container can include a sleeve 82 inserted into the bore 80 of the extension member. The sleeve can be a separate part that is inserted through the extension member or the sleeve can be molded as part of the extension member. The sleeve provides a larger and/or longer bearing surface for supporting the container on the spindle. Alternatively, the sleeve can be sized to support the container by inserting the sleeve into the roll's core. The sleeve or extension member can be used as a brake to control the roll's rotation during dispensing of the dry substrate by pressing on the sleeve or container. Additional sleeves and or extension members can be used to mount the container on a horizontal spindle. For example, the container can have an extension member and a sleeve on each end.

The sleeve can extend for a distance greater than the thickness of the extension member. The sleeve can be centered on the extension member, or the sleeve can have either end flush with the either side of the extension member, or the sleeve can have both ends extend past both sides of the extension members. The length of the sleeve can be used for varying the vertical spacing between the extension member and the base, the roll, or both to reduce frictional drag or to use the extension member as a roll brake.

In one embodiment, the freestanding dispenser included a brace 88 between the container 78 and the base 26. The brace can be used instead of the sleeve or in combination with the sleeve to further stabilize the container during dispensing. The brace can be molded as an extension of the container or be attached to the container or the base by a fastening element.

In one embodiment, the container includes a top 28, a bottom 30, a sidewall 32, and a dispensing opening 50 in the top. However, the dispensing opening can be located anywhere on the container for access into the interior where the wet substrate 24 is located. As mentioned previously, the dispensing opening can include any manner of plastic films, dispensing windows, flexible dispensing members, or dispensing flanges that project into the dispensing opening or reside in or adjacent to the dispensing opening for assisting in dispensing the wet substrate. The sidewall can include four generally rectangular panels having 90 degree corners as illustrated or the sidewall can be any other convenient shape. The bottom 30 of the container can be arcuate to enable the container to be closely positioned adjacent the roll. As discussed, the extension member can extend from the sidewall.

In one embodiment, the container's bottom and sidewall were molded as one piece and the top was attached to the sidewall by a hinge. The top can be opened by pivoting the top on the hinge. Once opened, the container can be refilled with the wet substrate, such as an interfolded stack of wet wipes, when the wet substrate is depleted.

The container can also include a dispensing door 54. The dispensing door can be attached to the container as needed for covering the dispensing opening. For example, the dispensing door can be attached to the pivoting top by a hinge 56. The dispensing door can be biased to spring open by a biasing element such as a spring, a torsion bar, a sealing ring surrounding the opening, or a flexible strip. To open the dispensing door, a button 58 can be pushed to unlock the dispensing door allowing it to spring open.

Figure 2:
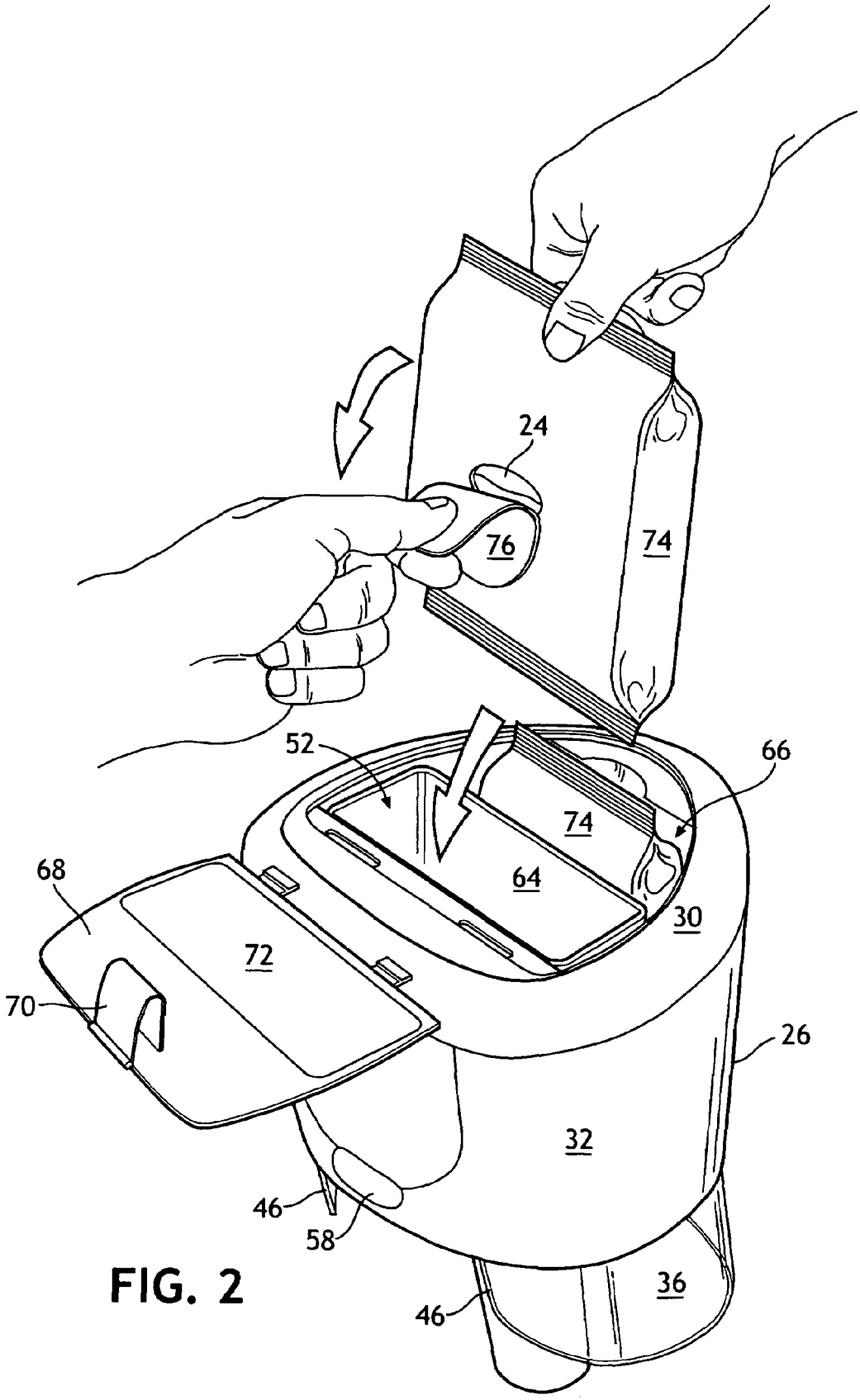
FIG. 2 illustrates a bottom perspective view of the embodiment of FIG. 1.
Figure 4:
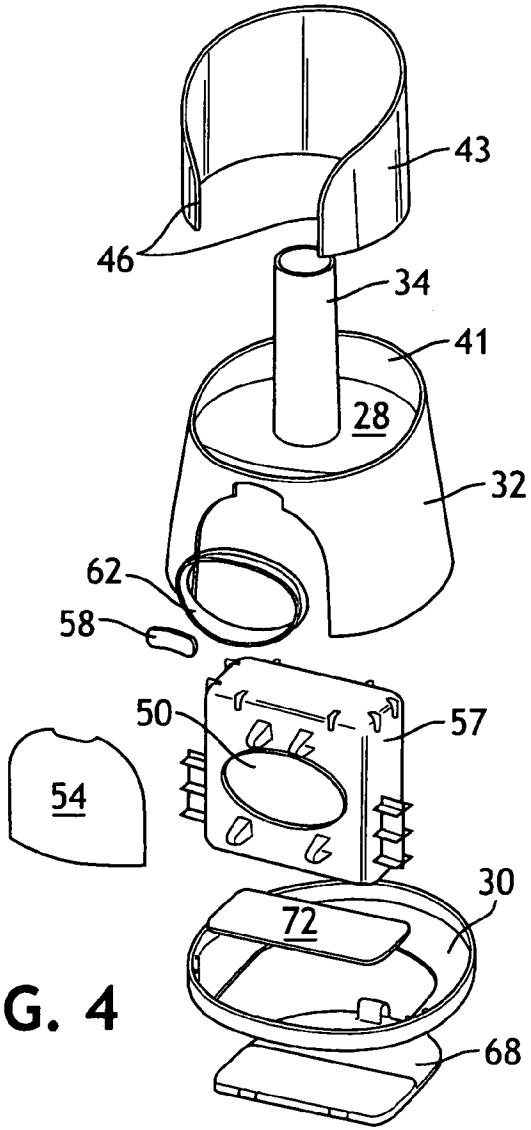
FIG. 4 illustrates an assembly drawing for the embodiment of FIG. 1.
Figure 3:
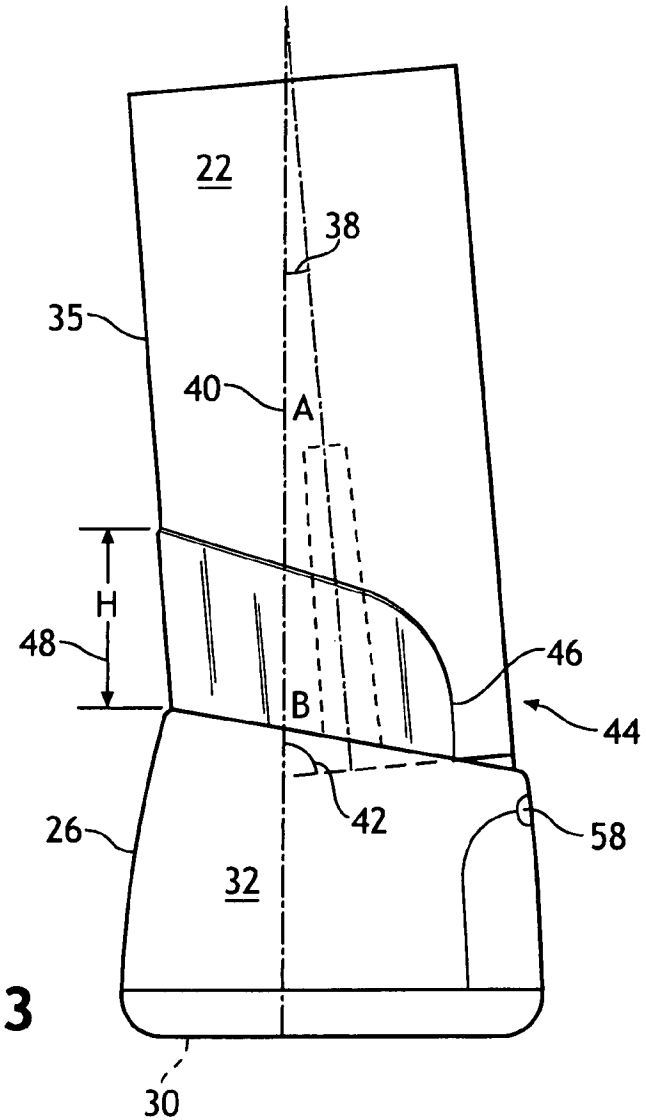
FIG. 3 illustrates a side view of the embodiment of FIG. 1.

In another embodiment, the container 78 can comprise a modified flexible soft pack similar to the soft pack 74 illustrated in FIG. 2. The flexible pack can be modified by extending the sealing flaps on one or both ends of the flexible pack and providing a bore in the extended sealing flap. The extended sealing flaps may comprise a sealing line near the wet substrate as shown in FIG. 2 with an extension member 86 extending from the sealing line that contains the bore. Another sealing line can be placed around the bore, and/or placed across the end of the extended sealing flap such that the bore is between two generally parallel sealing lines. If desired, a sleeve can be inserted into the bore. The sleeve may include a groove on its exterior surface for retaining the extended sealing flap on the sleeve. The flexible container can be hung off of the spindle by placing the bore or sleeve in the extended sealing flap over the spindle and allowing the container to drape over the side of the roll as the extended sealing flap flexes over the roll's edge.

Thus, the freestanding dispenser enables ready access to both substrates and provides convenient dispensing of both substrates from one integrated freestanding dispenser. Furthermore, the freestanding dispenser is compact, enabling placement on counters or other substantially horizontal surfaces without taking up too much space.

Figure 9:
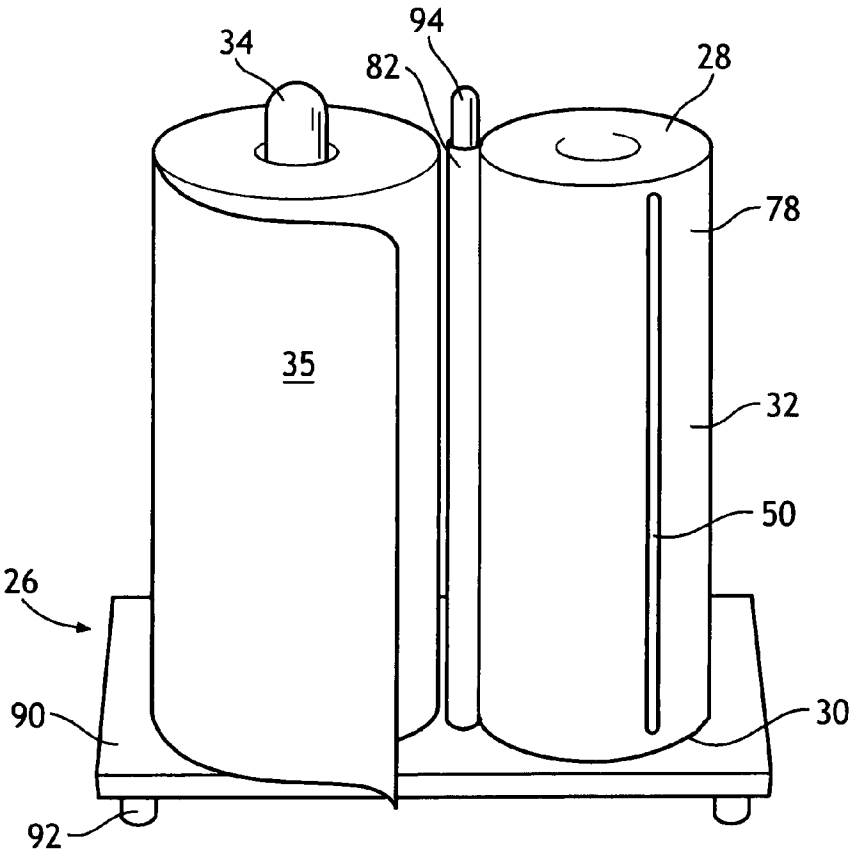
FIG. 9 illustrates another embodiment of the invention.

Referring now to FIG. 9, another embodiment of the invention is illustrated. The freestanding dispenser includes a substantially vertical spindle support member 34 attached to the base. In one embodiment, the base included a platform 90 and a plurality of legs 92. The freestanding dispenser also includes a substantially vertical container spindle 94. The container spindle is used to attach the container 78 to the freestanding dispenser adjacent the roll 35 as illustrated. This embodiment of the container is especially useful for dispensing rolls of the wet substrate. Any of the previously described options or features of the container can be included with this embodiment of the container.

In one embodiment, the container includes a top 28, a bottom 30, a sidewall 32, and a dispensing opening 50. The dispensing opening can be located in either the top or the sidewall. The dispensing opening may be shaped like a slot or slit for dispensing rolls of the wet substrate. The dispensing opening may be covered by a dispensing cover or dispensing membrane (flap) for improved moisture retention. The dispensing opening may include a curved notch or indention such that a small portion of the wet substrate is exposed to grab while the remainder of the wet substrate resides within the container.

The container can include a sleeve 82 attached to the sidewall. The sleeve enables the container to be attached to the freestanding dispenser by sliding the sleeve onto the container spindle. Alternatively, the container can include a bore 80 though the top and the bottom. The bore enables the container to be attached to the freestanding dispenser by sliding the container onto the container spindle adjacent the roll as desired. If desired, the bore can include a sleeve positioned within the container.

Other means of attaching the container to the container spindle may be used. For example, the container can include clips, or a strap, or the sidewall of the container can have a notch or groove that snaps onto the container spindle. Alternatively, the container can have the container spindle attached to it (for example on the side or the bottom) and the base can have a hole into which the container spindle is inserted.

Thus, the freestanding dispenser enables ready access to both substrates and provides convenient dispensing of both substrates from one integrated freestanding dispenser. Furthermore, the freestanding dispenser is compact enabling placement on counters or other substantially horizontal surfaces without taking up too much space.

Figure 10:
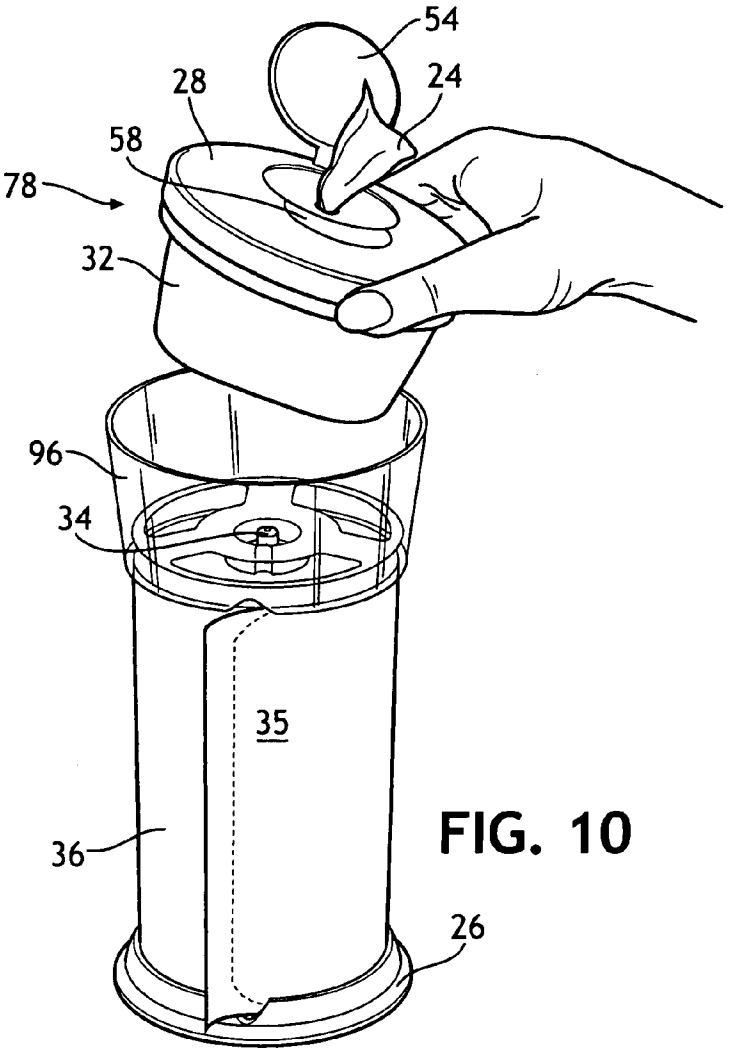
FIG. 10 illustrates another embodiment of the invention.

Referring now to FIG. 10, another embodiment of the invention is illustrated. In this embodiment of the freestanding dispenser, the roll 35 is supported by a spindle support member 34 attached to the base 26. The spindle can be either permanently affixed to the base or detachable from the base by using a fastening element. The wet substrate 24 is housed in a separate removable container 78. Any of the features of the previous containers can be used with this embodiment. The container can be vertically stacked above the roll 35 and attached to the spindle by directly placing the container onto the spindle. Alternatively, a dish 96 can be attached to the spindle and the container indirectly attached to the spindle by placing the container in the dish.

For direct attachment to the spindle, the bottom of the container can include a bore or blind hole enabling the container to be placed on the spindle's end. Similarly, the dish 96 can include a sleeve for placement over the spindle's end. The container includes a top 28, a bottom 30, a sidewall 32, and a dispensing opening 50 in the top.

In one embodiment, the top was reusable and formed of a durable material. The remaining portions of the container were disposable. For example, a thermoformed plastic package containing the wet substrate and having a film or foil removable top can be supplied. The removable film can be peeled off the container and the durable top having the dispensing cover 54 installed. Thereafter, the container can be placed into the dish on top of the roll. Alternatively, the container can be removed from the freestanding dispenser and used separately as needed. For instance, the container can be removed and taken along during short trips or on picnics for portable cleaning.

In one embodiment, the freestanding dispenser included a shroud 36 surrounding at least a portion of the roll. The shroud can be used to help stabilize the dish or to assist in dispensing the dry substrate by providing a surface to tear the substrate. Additionally, the shroud can be used to protect the first substrate from soiling or liquid spills. For example, the freestanding dispenser can be located close to the kitchen sink. By shrouding the dry substrate, inadvertent spills onto the dry substrate can be prevented or reduced. The shroud can extend from the base to the bottom of the dish and extend along the back and sides of the freestanding dispenser.

Thus, the freestanding dispenser enables ready access to both substrates and provides convenient dispensing of both substrates from one integrated freestanding dispenser. Furthermore, the freestanding dispenser is compact, enabling placement on counters or other substantially horizontal surfaces without taking up too much space.

The various components of the freestanding dispenser can be made from any suitable rigid material or flexible material that can bend or flex with minimal applied forces. Suitable flexible materials can include polyethylene, polyester, polypropylene, polyvinyl chloride, polyamide, acetate, cellophane, rubber, elastomeric materials, or metal foils amongst other suitable alternatives. The film can be single layer, a laminate of the above materials, or a laminate with a metal foil layer. Suitable rigid materials can include cardboard, polypropylene, polyethylene, polystyrene, ABS plastic, plastic, metal, wood, and glass amongst other suitable alternatives. The freestanding dispenser can be a combination of flexible and rigid materials.

Another dispenser for dispensing two substrates is disclosed in U.S. patent application Ser. No. 10/461,605 entitled Package Containing Two Different Substrates filed on Jun. 13, 2003 (attorney docket number 18527). Yet another dispenser for dispensing two different substrates is disclosed in U.S. patent application Ser. No. 10/324,860 entitled Packaging Two Different Substrates filed on Dec. 20, 2002.

Modifications and variations to the present invention may be practiced by those of ordinary skill in the art, without departing for the spirit and scope of the present invention, which are more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this specification, the information present in this specification shall prevail. The preceding description, given by way of example in order to enable one of ordinary skill in the art to practice the claimed invention, is not to be construed as limiting the scope of the invention, which is defined by the claims and all equivalents thereto.

We claim:

1. A freestanding dispenser for dual dispensing of a wet substrate and a dry substrate comprising:

a base for supporting the freestanding dispenser on a substantially horizontal surface;

a support member connected to the base, the support member adapted for holding a roll of a dry substrate in a substantially vertical position; wherein between approximately 50 percent to approximately 100 percent of the roll's exterior surface is exposed to provide ready access; and a source of a wet substrate supported by the freestanding dispenser placed vertically either above or below the roll.

2. The freestanding dispenser of claim 1 wherein the wet substrate is housed in a separate container attached to the freestanding dispenser.

3. The freestanding dispenser of claim 1 wherein between approximately 75 percent to approximately 100 percent of the roll's exterior surface is exposed.

4. The freestanding dispenser of claim 1 wherein:

the base comprises a top, a bottom, a sidewall, and at least one opening;

the support member comprises a spindle attached to the top; and the wet substrate is located inside of the base.

5. The freestanding dispenser of claim 1 wherein:

the base comprises a top, a bottom, a sidewall, and at least one opening;

the support member comprises a shroud; and the wet substrate is located inside of the base.

6. The freestanding dispenser of claim 1 wherein:

the base comprises a top, a bottom, a sidewall, and at least one opening;

the support member comprises a spindle and a shroud; and the wet substrate is located inside of the base.

7. The freestanding dispenser of claim 4 or 6 wherein the spindle is detachable from the top.

8. The freestanding dispenser of claim 4 or 6 wherein a diameter of the spindle is between about 5 mm to about 100 mm.

9. The freestanding dispenser of claim 4 or 6 wherein a length of the spindle is between about 10 mm to about 400 mm.

10. The freestanding dispenser of claim 4 or 6 wherein the spindle is attached at an angle A relative to a vertical axis between about 0 degrees to about 20 degrees.

11. The freestanding dispenser of claim 4 or 6 comprising a dispensing cover covering a dispensing opening located in the base.

12. The freestanding dispenser of claim 11 comprising a sealing ring surrounding the dispensing opening for sealing engagement when the dispensing cover is closed.

13. The freestanding dispenser of claim 12 wherein the dispensing cover springs open by force exerted from the cover compressing the sealing ring when closed.

14. The freestanding dispenser of claim 11 wherein the dispensing cover is pivotally attached to the base by a hinge.

15. The freestanding dispenser of claim 11 wherein the dispensing cover is opened by actuating a button.

16. The freestanding dispenser of claim 15 wherein the dispensing cover springs open when the button is actuated.

17. The freestanding dispenser of claim 4 or 6 wherein the base comprises a dispensing compartment and a storage compartment.

18. The freestanding dispenser of claim 4 or 6 comprising a dispensing opening in the sidewall and a refill opening in the bottom.

19. The freestanding dispenser of claim 18 comprising a dispensing cover and a refill cover.

20. The freestanding dispenser of claim 5 or 6 wherein the top is angled at an angle B relative to a vertical axis between about 70 degrees to about 90 degrees.

21. The freestanding dispenser of claim 5 or 6 wherein the top has a perimeter and the shroud is attached to the perimeter and extends along a portion of the perimeter.

22. The freestanding dispenser of claim 21 wherein the shroud comprises a gap.

23. The freestanding dispenser of claim 4, 5, or 6 wherein the dry substrate comprises a roll of paper towels.

24. The freestanding dispenser of claim 4, 5, or 6 wherein the wet substrate comprises a plurality of wet wipes contained in a package.

25. The freestanding dispenser of claim 24 wherein the package comprises a soft pack having a removable label for access to the wet wipes.

26. The freestanding dispenser of claim 1 comprising:

a separate container housing the wet substrate;

he container having a top, a bottom, and a sidewall;

the sidewall comprising a dispensing opening; and the container having a bore through the top and the bottom for placing the container onto a spindle acting as the support member.

27. The freestanding dispenser of claim 26 wherein the container is vertically stacked above the roll.

28. The freestanding dispenser of claim 26 wherein the container is vertically stacked below the roll.

29. The freestanding dispenser of claim 26 wherein the top is removable for refilling the container.

30. The freestanding dispenser of claim 26 wherein the wet substrate comprises a wet roll.

31. The freestanding dispenser of claim 26 wherein the container comprises a dispensing cover for covering the dispensing opening.

32. The freestanding dispenser of claim 26 wherein the container comprises a sleeve inserted into the bore.

33. The freestanding dispenser of claim 32 wherein the sleeve extends past both the top and bottom.

34. The freestanding dispenser of claim 1 wherein:

the base comprises a top, a bottom, and a sidewall;

the support member comprises a hollow spindle attached to the top;

the wet substrate is located inside of the base; and wherein the wet substrate is dispensed by threading the substrate through the hollow spindle.

35. The freestanding dispenser of claim 1 comprising:

a substantially vertical spindle support member attached to the base;

a container housing the wet substrate, the container having a top, a bottom, a sidewall, and a dispensing opening; and the container directly or indirectly attached to the spindle above the roll.

36. The freestanding dispenser of claim 35 wherein the bottom of the container comprises a bore for attachment to the spindle.

37. The freestanding dispenser of claim 35 comprising a dish attached to the spindle above the roll and the container placed in the dish.

38. The freestanding dispenser of claim 37 wherein the dispensing opening is located in the top.

39. The freestanding dispenser of claim 38 wherein the top is removable for refilling the container.

40. The freestanding dispenser of claim 38 comprising a dispensing cover for covering the dispensing opening.

41. The freestanding dispenser of claim 40 wherein the dispensing cover is opened by pressing a button.

42. The freestanding dispenser of claim 41 wherein the dispensing cover springs open.

43. The freestanding dispenser of claim 37 comprising a shroud attached to the base.

44. The freestanding dispenser of claim 43 wherein the shroud extends from the base to the dish.

45. The freestanding dispenser of claim 35 comprising a shroud attached to the base.

* * * * *